US006771780B2

(12) United States Patent
Hong et al.

(10) Patent No.: US 6,771,780 B2
(45) Date of Patent: Aug. 3, 2004

(54) TRI-FUNCTIONAL DUAL EARPHONE DEVICE

(76) Inventors: Chi-Lin Hong, 235 Chung - Ho Box 8-24, Taipei (TW); His-Yuan Lai, 235 Chung - Ho Box 8-24, Taipei (TW)

( * ) Notice: Subject to any disclaimer, the term of this patent is extended or adjusted under 35 U.S.C. 154(b) by 270 days.

(21) Appl. No.: 10/127,147

(22) Filed: Apr. 22, 2002

(65) Prior Publication Data

US 2003/0198355 A1 Oct. 23, 2003

(51) Int. Cl.[7] ..... H04R 1/10; H04R 25/00
(52) U.S. Cl. ..... 381/74; 381/384; 381/55
(58) Field of Search ..... 381/74, 26, 111, 381/123, 122, 370, 374, 375, 384, 55; 379/430, 446, 408.2; 455/575.2, 569.1

(56) References Cited

U.S. PATENT DOCUMENTS 4,538,296 A * 8/1985 Short et al. ..... 381/72
4,829,571 A * 5/1989 Kakiuchi et al. ..... 381/309
5,050,214 A * 9/1991 Lee ..... 381/311
5,448,646 A * 9/1995 Lucey et al. ..... 381/74
5,715,321 A * 2/1998 Andrea et al. ..... 381/92
5,740,254 A * 4/1998 Thompson et al. ..... 381/309
5,761,298 A * 6/1998 Davis et al. ..... 379/430
5,784,241 A * 7/1998 Munch et al. ..... 361/111
6,104,821 A * 8/2000 Husung ..... 381/312
6,122,369 A * 9/2000 Hwang et al. ..... 379/420.04
6,198,821 B1 * 3/2001 Yang ..... 379/420.04
6,397,087 B1 * 5/2002 Kim et al. ..... 455/569.1

FOREIGN PATENT DOCUMENTS

GB 2152786 * 8/1985 ..... 381/55

* cited by examiner

*Primary Examiner*—Xu Mei

(57) ABSTRACT

A tri-functional dual earphone device is disclosed. The structure includes an earphone device and a hand free receiver of the earphone device with circuit structure therein. One end of the earphone device is installed with a left earphone and a right earphone which are connected by a lead, and a hand free receiver suitable. A microphone, a volume control switch for adjusting volume freely, and a function selecting switch are installed in the hand free receiver. Another end of the earphone device is connected to a joint through the lead so as to provide for various mainframes, such as mobile phones (CDMA, TDMA, PHS, GSM, AMPS), digital cameras, digital TVs, MP3, GPRS, PDAs and other electronic devices or communication devices. Moreover, the earphone device has a freely moveable clip which are appended to the lead for clamping to the user.

7 Claims, 6 Drawing Sheets

TRI-FUNCTIONAL DUAL EARPHONE DEVICE

FIELD OF THE INVENTION

The present invention relates to earphone devices, and particularly to a tri-functional dual earphone device. A microphone, a volume control switch for adjusting volume freely, and a function selecting switch are installed in one hand free receiver. A function selecting switch has functions according to personal computers, net phones of Internet, digital TVs and cameras. Likely, when the present invention is connected to a MP3, etc., it is used as a controller for stopping/playing music. When the present invention is used in GPRS and PDA, it has function of recording.

BACKGROUND OF THE INVENTION

The current hand free earphone device is used to a mobile phone so that the user is unnecessary to hold a receiver as receiving a call. However, the prior art has only one function and is matched to a specific handset. If the handset is updated, then the user must bye a new one. Thereby, other related parts can not be used further.

Moreover, in the prior art earphone device, the microphone and control button is separated from one another. However, this will induce an inconvenience in manufacturing and assembly. Moreover, many earphone device has only one earphone, thereby, the user can not enjoy a high quality sound effect.

SUMMARY OF THE INVENTION

Accordingly, the primary object of the present invention is to provide a tri-functional dual earphone device, which can improve the defects in the prior art. Several functions are collected in one circuit and the present invention is suitable for various kinds of mainframes.

The structure of the present invention includes an earphone device and a hand free receiver of the earphone device with circuit structure therein.

One end of the earphone device is installed with a left earphone and a right earphone which are connected by a lead, and a hand free receiver suitable for a hand free receiver. A microphone, a volume control switch for adjusting volume freely, and a function selecting switch are installed in the hand free receiver. Another end of the earphone device is connected to a joint through the lead so as to provide for various mainframes, such as mobile phones (CDMA, TDMA, PHS, GSM, AMPS), digital cameras, digital TVs, MP3, GPRS, PDAs and other electronic devices or communication devices. Moreover, the earphone device has a freely moveable clip which are appended to the lead for clamping-to the user.

The circuit of the hand free receiver comprises the following components.

A left and right channel volume control unit serves for controlling the volumes of the left earphone and right earphone.

An EMI electromagnetic-proof filtering network is an LC lump circuit for preventing from EMI interference.

A function module selection control unit has functions based on a mainframe connected.

A sound collector voltage protecting circuit serves for protecting a microphone.

A speaker device serves for emitting sound.

A microphone sound collector serves for receiving sound.

An I/O (input/output) adapter serves for being connected with an outside device.

The I/O adapter is connected to the left and right channel volume control unit. The EMI electromagnetic-proof filtering network is connected to the I/O adapter. The function selecting switch is connected to the EMI electromagnetic-proof filtering network. The sound collector voltage protecting circuit is connected to the function selecting switch. The microphone sound collector is connected to the sound collector voltage protecting circuit, and the left and right channel volume control unit is connected to the speaker device.

The various objects and advantages of the present invention will be more readily understood from the following detailed description when read in conjunction with the appended drawing.

DETAILED DESCRIPTION OF THE PREFERRED EMBODIMENTS

Referring to appended drawings, the tri-functional dual earphone device of the present invention is illustrated. The structure thereof includes an earphone device and a hand free receiver 12 of the earphone device 1 with circuit structure 2 therein.

Figure 1:
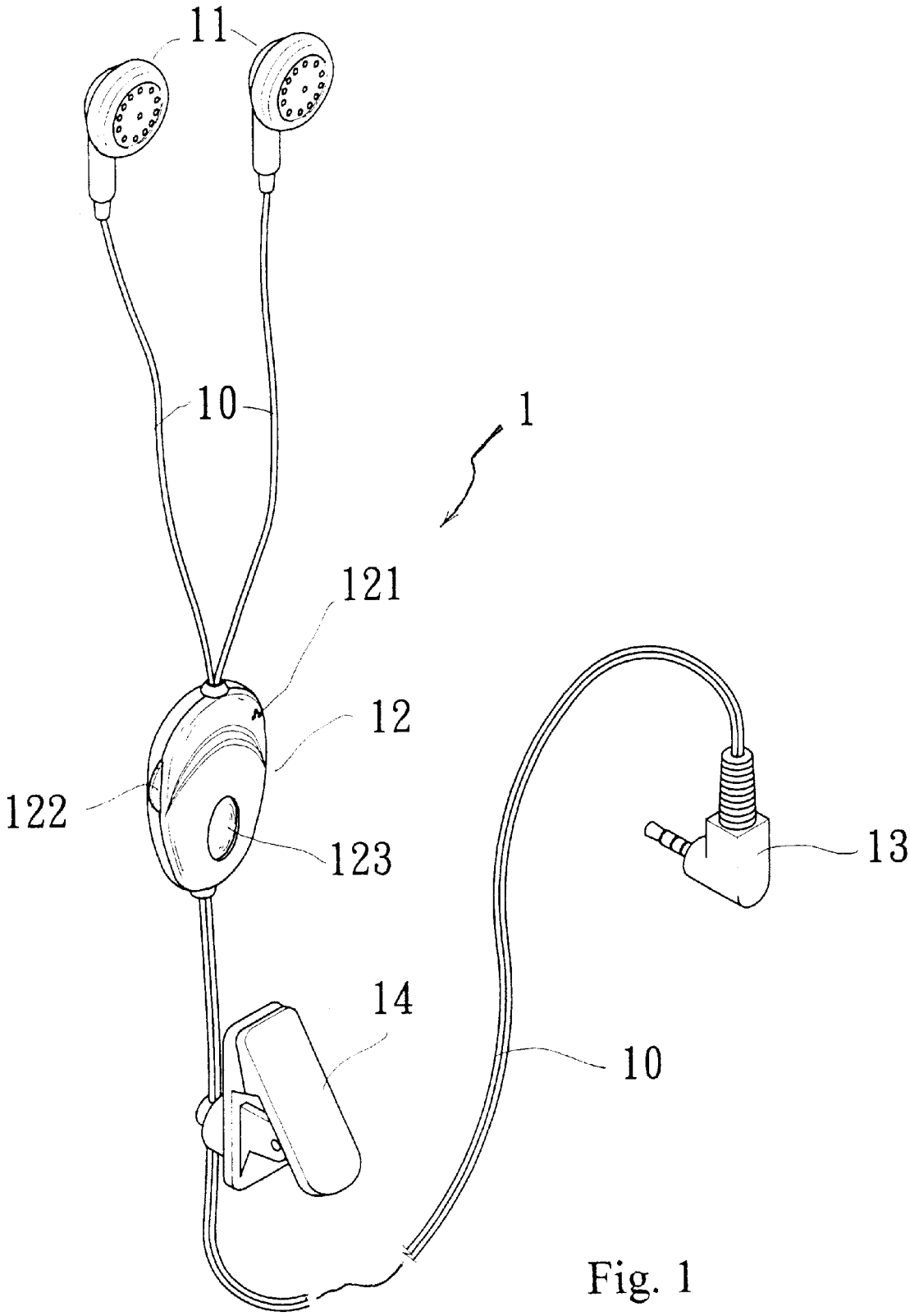
FIG. 1 is a perspective view of an earphone device of the present invention.
Figure 2:
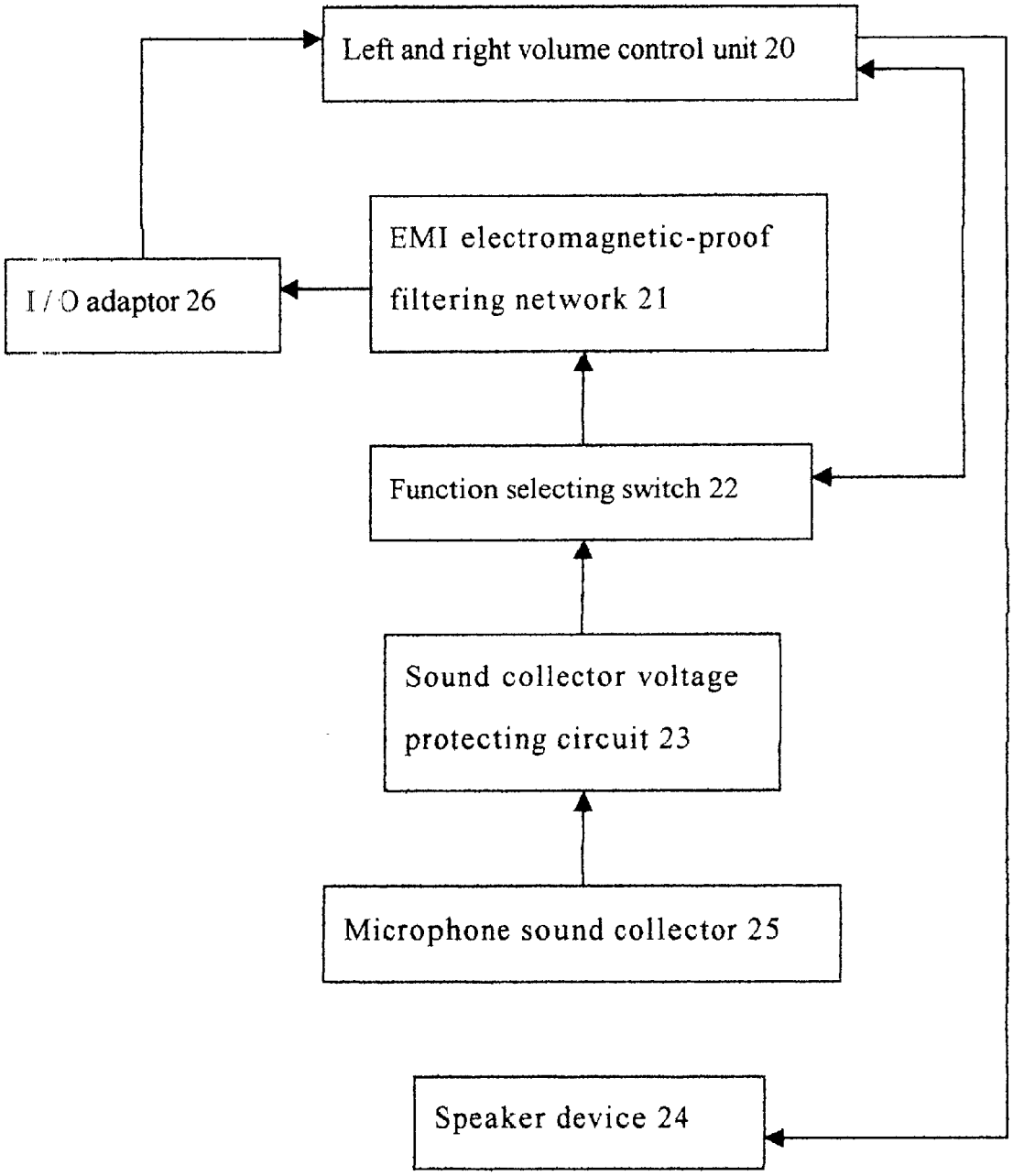
FIG. 2 is a block diagram of the earphone device of the present invention.
Figure 3:
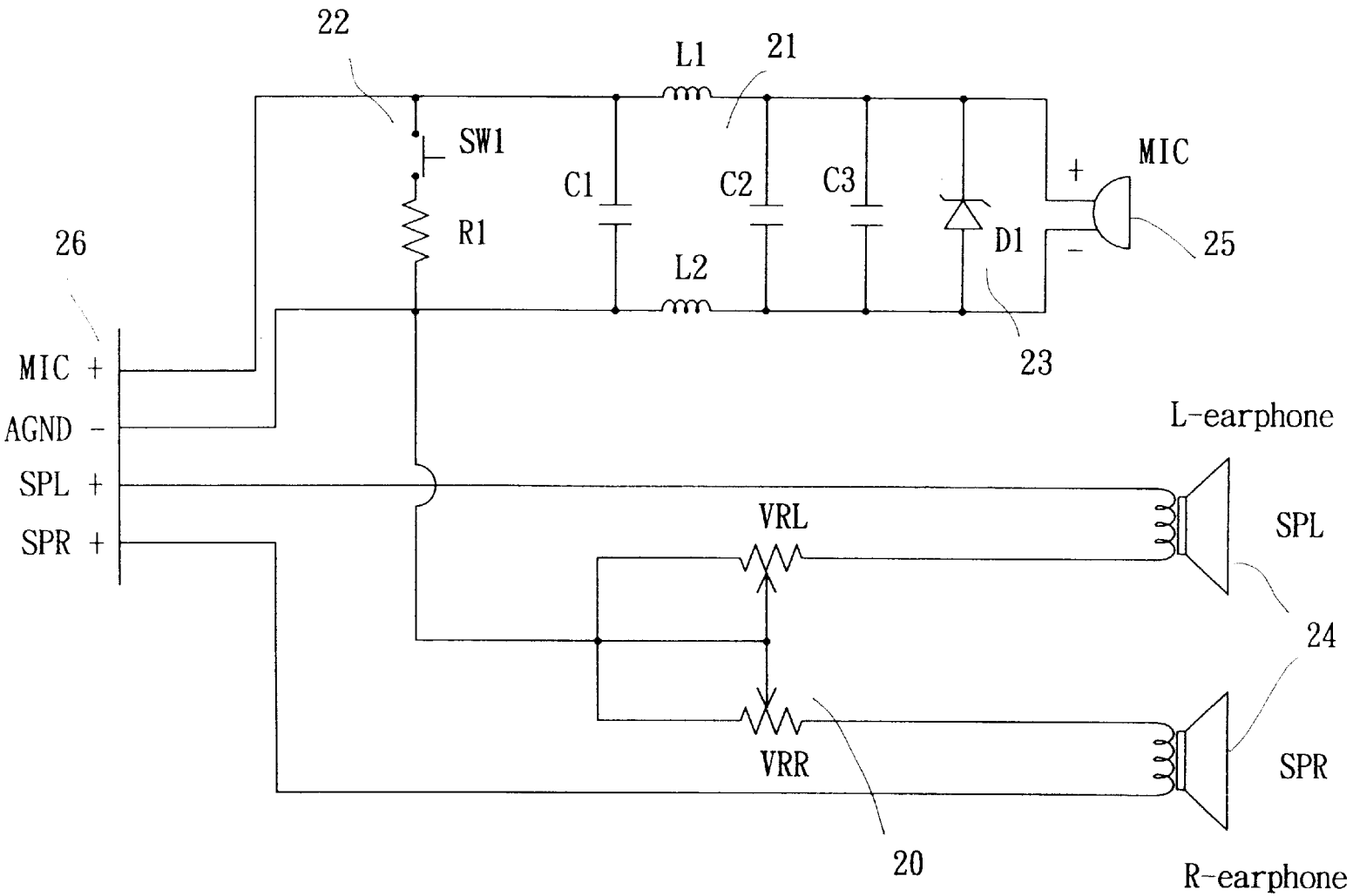
FIG. 3 shows a first circuit in one preferred embodiment of the present invention.

Referring to FIG. 1, one end of the earphone device 1 is installed with a left earphone and a right earphone which are connected by a lead 10, and a hand free receiver 12. A microphone 121, a volume control switch 122 for adjusting volume freely, and a function selecting switch 123 are installed in the hand free receiver 12. Another end of the earphone device 1 is connected to a joint 13 through the lead 10 so as to provide for various mainframes, such as mobile phones (CDMA, TDMA, PHS, GSM, AMPS), digital cameras, digital TVs, MP3, GPRS, PDAs and other electronic devices or communication devices. Moreover, the earphone device 1 has a freely moveable clip 14 which are appended to the lead 10 for clamping to the user.

The function selecting switch 123 of the hand free receiver 12 is a single control switch with a plurality of functions which is dependent on the mainframe connected. The functions are such as mobile phone receiving/turn off control, speech dialing, MP3 music stop and play operation, forward/backward operation, GPRS and PDA recording.

Moreover, the joint 13 may have different structure based on the mainframe. In use, the joint 13 may be a single one joint or a dual adapter.

The circuit structure 2 of the present invention is illustrated in FIGS. 2 to 6. The circuit structure 2 has the following components.

A left and right channel volume control unit 20 serves for controlling the volumes of the left earphone and right earphone by disk-like potential adjusters VRL and VRR.

An EMI electromagnetic-proof filtering network 21 is an LC lump circuit formed by inductors L1 and L2, capacitors C1, C2 and C3, etc for preventing from EMI interference.

A function module selection control unit 22 is formed by a switch SW1, resistor R1, etc. The function of unit 22 is based on the mainframe connected.

A sound collector voltage protecting circuit 23 is formed by a voltage regulating diode D1, which has the function of protecting microphone.

A speaker device 24 includes a left speaker SPL and a right speaker SPR for emitting sound.

A microphone sound collector 25 is the MIC illustrated in the drawing.

The I/O (input/output) adapter 26 is an adapter having two ports for communicating with above mentioned units and is a medium for connecting various mainframe.

The I/O adapter 26 is connected to the left and right channel volume control unit 20, the EMI electromagnetic-proof filtering network 21 is connected to the I/O adapter, the function selecting switch is connected to the EMI electromagnetic-proof filtering network 21, the sound collector voltage protecting circuit 23 is connected to the function selecting switch, the microphone sound collector is connected to the sound collector voltage protecting circuit, and the left and right channel volume control unit 20 is connected to the speaker device 24.

By above unit, the hand free receiver 12 has a microphone, a volume control switch, a function selecting switch. Three circuits are assembled in one unit.

The use of the present invention will be described in the following.

For example, if the present invention is used in a mobile phone. The earphone device 1 of the present invention is thereof to a mobile phone. Now, the function selecting switch 123 of the hand free receiver 12 of the earphone device 1 has a receiving/turning off function and speech dialing. Of course, the function selecting switch 123 has functions according to personal computers, Internet phones, digital TVs and cameras. Likely, when the present invention is connected to a MP3, etc., the present invention is used as a control for stopping/playing music. When the present invention is used in GPRS and PDA, it has function of recording.

Figure 4:
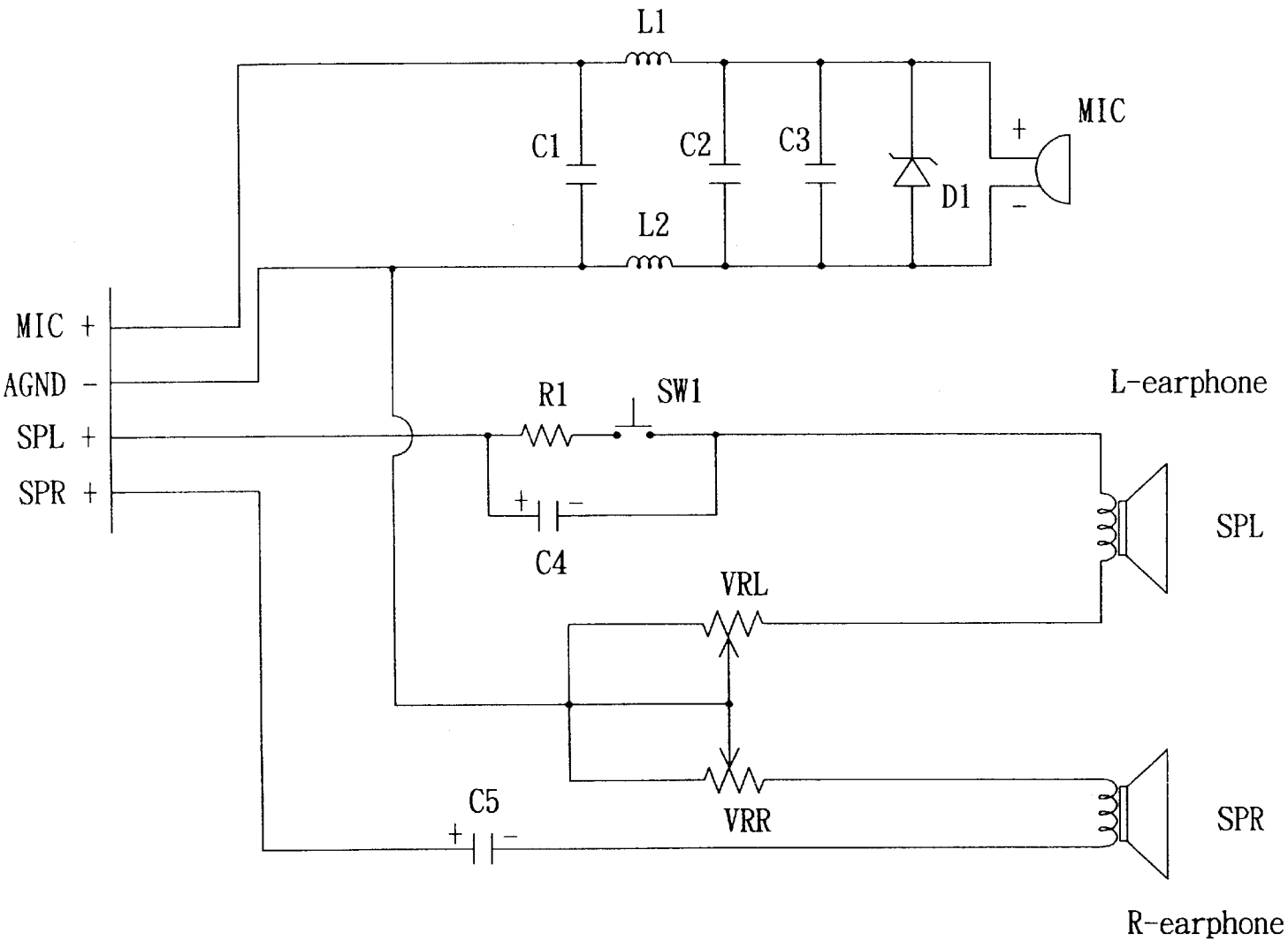
FIG. 4 shows a second circuit in one preferred embodiment of the present invention.

Referring to FIG. 4, another embodiment of the present invention is illustrated. In this embodiment, the function mode selection control unit 22 in the hand free receiver 12 is removed to be connected to the left trumpet in the trumpet speaker (left and right speakers) 24. It includes switch SW1, a resistor R1, and a capacitor C4. A capacitor C5 is added to the right trumpet. Thereby, the present invention is constructed with only one joint.

Figure 5:
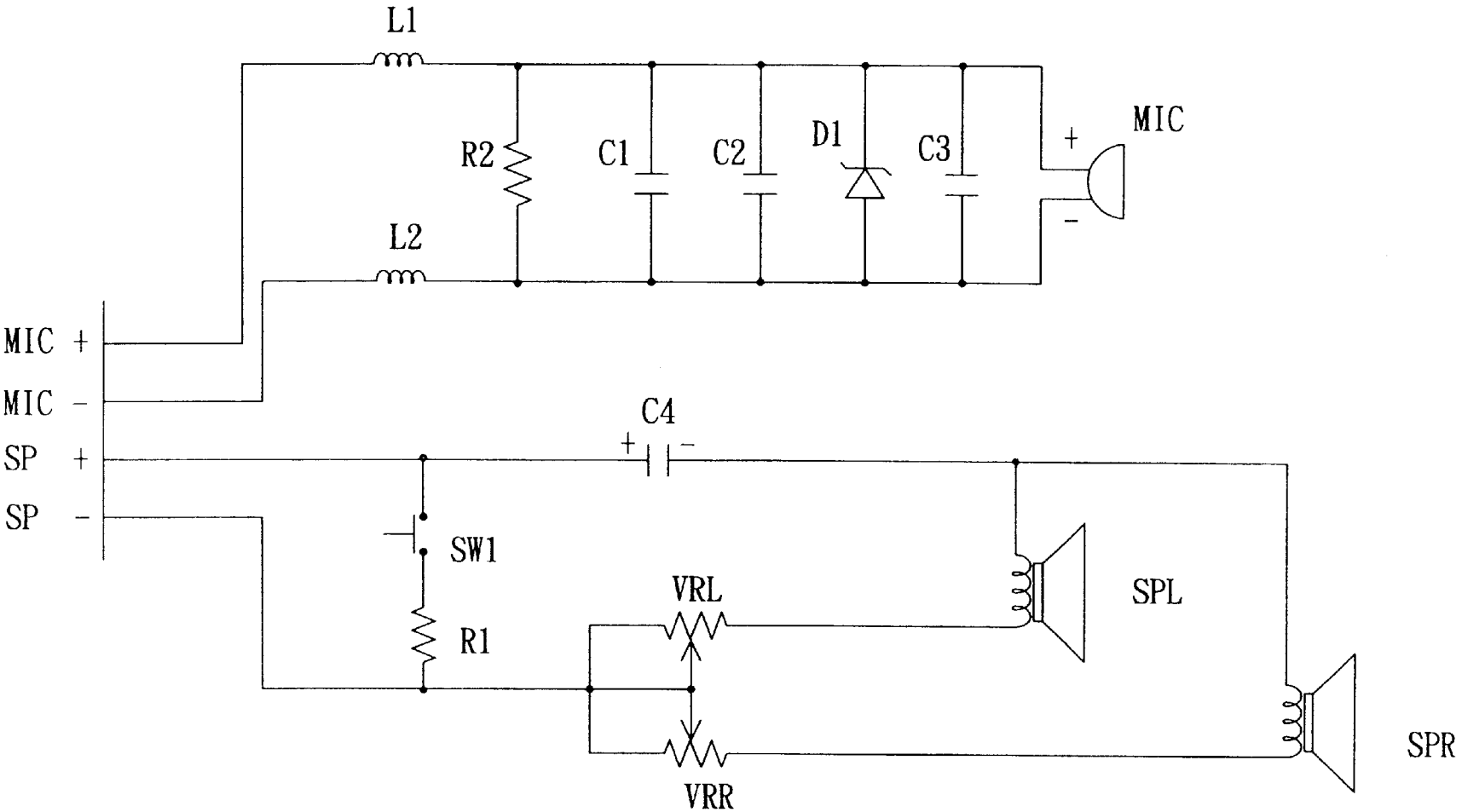
FIG. 5 shows a third circuit in one preferred embodiment of the present invention.

Referring to FIG. 5, a further embodiment of the present invention is illustrated. In this embodiment, the LC circuit formed by the inductors L1, L2 and capacitors C1, C2 and C3 of the EMI electromagnetic-proof filtering network 21 of the hand free receiver 12 is added with a resistor R2 so as to be formed as an RLC collecting circuit which has electromagnetic-proof filtering effect. Meanwhile, the speaker device 24 (including left and right speakers) is rearranged. Thereby, the present invention has a single one joint 24.

Figure 6:
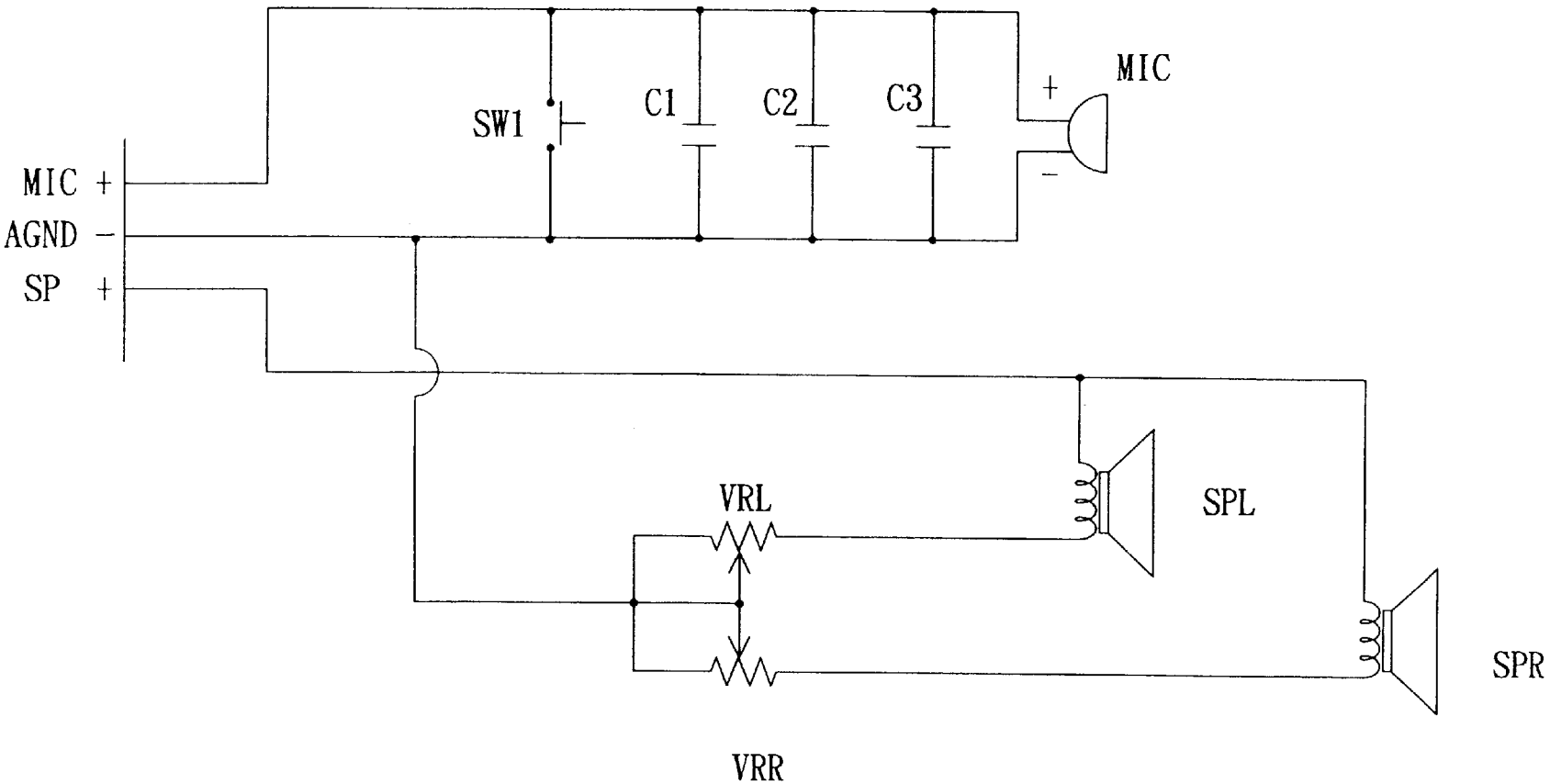
FIG. 6 shows a fourth circuit in one preferred embodiment of the present invention.

With reference to FIG. 6, a yet embodiment of the present invention is illustrated. The circuit has been simplified. In this circuit, the switch SW1 is rearranged. The inductor L1, L2 and resistor R2 are neglected. Moreover, in the circuit of earphone, no interconnected circuit is used. Thereby, a circuit with one joint is formed.

Although there are various forms used in the present invention, basically, the present invention has the functions of hand free receiver, dual earphone device, and function selection.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A tri-functional dual earphone device comprising an earphone device and a hand free receiver; the hand free receiver having a circuit; the circuit of the hand free receiver comprising:

a left and right channel volume control unit for controlling the volumes of the earphone device;

an EMI electromagnetic-proof filtering network being an LC lump circuit for preventing from EMI interference;

a function module selection control unit having functions based on a mainframe connected;

a sound collector voltage protecting circuit for protecting a microphone;

a speaker device for emitting sound;

a microphone sound collector for receiving sound;

an I/O (input/output) adapter for being connected with an outside device;

wherein the I/O adapter is connected to the left and right channel volume control unit, the EMI electromagnetic-proof filtering network is connected to the I/O adapter, the function module selection control unit is connected to the EMI electromagnetic-proof filtering network, the sound collector voltage protecting circuit is connected to the function module selection control unit, the microphone sound collector is connected to the sound collector voltage protecting circuit, and the left and right channel volume control unit is connected to the speaker device.

2. The tri-functional dual earphone device as claimed in claim 1, wherein one end of the earphone device is installed with a left earphone and a right earphone which are connected by a lead, and a hand free receiver; a microphone, a volume control switch for adjusting volume freely, and a function selecting switch are installed in the hand free receiver; another end of the earphone device is connected to a joint through the lead; the earphone device has a freely moveable clip which are appended to the lead.

3. The tri-functional dual earphone device as claimed in claim 1, wherein the I/O adapter has one port.

4. The tri-functional dual earphone device as claimed in claim 1, wherein the I/O adapter has two ports.

5. The tri-functional dual earphone device as claimed in claim 1, wherein the earphone device has a function selecting switch.

6. The tri-functional dual earphone device as claimed in claim 1, wherein EMI electromagnetic-proof filtering network is an LC circuit.

7. The tri-functional dual earphone device as claimed in claim 1, wherein the EMI electromagnetic-proof filtering network is an RLC circuit.

* * * * *